US006739836B2

(12) United States Patent
Pinzauti et al.

(10) Patent No.: US 6,739,836 B2
(45) Date of Patent: May 25, 2004

(54) CONNECTION OF BLADES ON A ROTOR DISC OF A GAS TURBINE

(75) Inventors: Massimo Pinzauti, Florence (IT); Giacomo Giovangrossi, Florence (IT); Alessio Anichini, Lastra a Signa (IT)

(73) Assignee: Nuovo Pignone Holding S.p.A., Florence (IT)

( * ) Notice: Subject to any disclaimer, the term of this patent is extended or adjusted under 35 U.S.C. 154(b) by 6 days.

(21) Appl. No.: 10/245,712

(22) Filed: Sep. 18, 2002

(65) Prior Publication Data

US 2003/0068197 A1 Apr. 10, 2003

(30) Foreign Application Priority Data

Sep. 21, 2001 (IT) ..... MI2001A1970

(51) Int. Cl.[7] ..... F01D 5/30
(52) U.S. Cl. ..... 416/219 R; 416/248
(58) Field of Search ..... 416/219 R, 239, 416/248

(56) References Cited

U.S. PATENT DOCUMENTS 4,260,331 A * 4/1981 Goodwin ..... 416/219 R

* cited by examiner

*Primary Examiner*—Edward K. Look
*Assistant Examiner*—Kimya N McCoy
(74) *Attorney, Agent, or Firm*—Nixon & Vanderhye

(57) ABSTRACT

An improved connection of blades (12) on a rotor disc (22) of a gas turbine, of the type in which a root (10) of each blade (12) is inserted in a seat (20) of the disc (22) which is complementary to the blade, wherein the root (10) is in the shape of an overturned isosceles triangle, with the two sides which converge at the base each having a grooved profile such as to form a series of teeth (14) and with a lower end (16) of the root (10) which is formed by the joined connection of the two lower teeth (14) of the two sides of the root (10), the teeth (14) of the root (10) corresponding to grooves (24) in the seat (20) and the lower end (16) of the root (10) corresponding to an end groove (26) in the seat (20). This series of grooves (24) extends along a line which is inclined relative to the axis of the seat (20) by an angle $\alpha_1$ of between 17° and 23°, and the grooves (24) have straight sides with inclinations relative to the axis of the seat (20) of angles $\alpha_1$ and $\alpha_2$, wherein $\alpha_1$ is between 42° and 48° whereas $\alpha_2$ is between 94° and 100°.

4 Claims, 1 Drawing Sheet

CONNECTION OF BLADES ON A ROTOR DISC OF A GAS TURBINE

The present invention relates to an improved connection of blades on a rotor disc of a gas turbine.

As is known, gas turbines are machines which consist of a compressor and a turbine with one or more stages, wherein these components are connected to each other by a rotary shaft and wherein a combustion chamber is provided between the compressor and the turbine.

The gas output from the combustion chamber, which has a high temperature and a high pressure, reaches through corresponding pipes the different stages of the turbine, which transforms the enthalpy of the gas into mechanical energy available to a user.

In turbines with two stages the gas is processed in the first stage of the turbine in temperature and pressure conditions which are very high and undergoes a first expansion there.

Then, in the second stage of the turbine it undergoes a second expansion in temperature and pressure conditions which are lower than those used in the preceding stage.

It is also known that in order to obtain the maximum performance from a specific gas turbine it is necessary for the temperature of the gas to be as high as possible.

However, the maximum temperature values which can be obtained in use of the turbine are limited by the resistance of the materials which are used at present.

It is also known that in gas turbines the rotor blades do not form a single body with the rotor disc, but are retained by means of their base extensions in appropriate seats provided on the circumference of the disc.

In particular, the seats used at present have sides with a grooved profile, in which the end portion of the foot or root of the corresponding blade is engaged.

A problem which is particularly significant in the present art is therefore that of guaranteeing an optimal connection of the blades on the rotor disc, in all the conditions of functioning of the machine.

In fact it should be noted that the method of connection of the blades on the rotor disc represents a crucial aspect of the design of any rotor, taking into account the fact that the disc must withstand satisfactorily and reliably the loads generated by the blades without giving rise to breakages or other similar problems.

In fact it is known that during functioning of the machine, the rotor blades are subjected to high stresses both in the radial direction, and to a lesser extent in the axial direction.

The radial stresses are caused by the high speed of rotation of the turbine, whereas the axial stresses are caused by the effect produced by the flow of gas on the profiled surfaces of the blades.

The same flow of gas transmits to the blades the circumferential component of the stress which makes it possible to gather useful power at the drive shaft.

However, the method of connection of the blades must use the smallest possible dimensions, occupying truly limited spaces, such as to reduce the assembly constituted by the rotor disc and blades to the smallest possible dimensions.

Furthermore, nowadays, the trend is to obtain gas turbines with increasingly high performance levels.

This involves the fact of having to increase both the speed of rotation and the combustion temperature. There is consequently also an increase in the temperature of the gases which expand in the stages of the turbine against the blades.

In fact this gives rise to an increase in the stresses on the connection between the blades and rotor discs of the turbine, with increasingly great difficulty in guaranteeing an adequate service life of the blades and rotor discs.

At present the connection most widely used is that which is commonly known as the "pine tree" type.

It consists of shaping the root or foot of the blade such that its cross-section assumes a characteristic shape which is reminiscent of an overturned pine tree.

In this particular form the sides of the root have a grooved profile such as to form a series of teeth with a rounded profile; otherwise, in its lower end the root is formed by the connection of the two lower teeth of the two sides.

These roots are connected to seats or coupling slots complementary to them which are provided on the circumference of the rotor disc, such that grooves in the sides of the seat correspond to the teeth of the root and a groove at the base of the seat corresponds to the lower end of the root.

In conventional embodiments, these seats for the roots of the blades extend in a direction which is substantially parallel to the axis of the rotor disc.

On the other hand in different embodiments, the seats for the roots extend substantially in a direction which is inclined relative to the axis of the disc itself.

This type of connection has areas of particular concentration of stress which can be determined more specifically as being at the bottom of the groove, on the base of the seat, and on the base of the grooves of each tooth, which constitutes the actual connection profile.

The main object of the present invention is thus to eliminate the above-described disadvantages and in particular to provide an improved connection for blades on a rotor disc of a gas turbine which makes it possible to reduce the concentrations of stress, thus making it possible to increase the speed of rotation of the machines or to increase the temperature of the fluid, or an appropriate combination of these factors.

Another object of the present invention is to provide an improved connection of blades on a rotor disc of a gas turbine, which permits easy assembly and dismantling, according to requirements, of the blades of the different stages of the turbine.

Another object of the present invention is to provide an improved connection of blades on a rotor disc of a gas turbine which is also highly reliable.

A further object of the present invention is to obtain a service life of the components which is far longer than that which can be obtained at present with the connections used.

A further object of the present invention is to provide an improved connection of blades on a rotor disc of a gas turbine which is particularly simple and functional, has relatively low costs, and can be produced by means of conventional processing.

According to the invention it has also been possible to determine that the reduction of the maximum values of the stresses in the areas of concentration of the forces gives rise to a considerable increase in the life of the components.

The characteristics and advantages of an improved connection of blades on a rotor disc of a gas turbine according to the present invention will become more apparent from the following description provided by way of non-limiting example with reference to the attached schematic drawings, in which.

Figure 1:
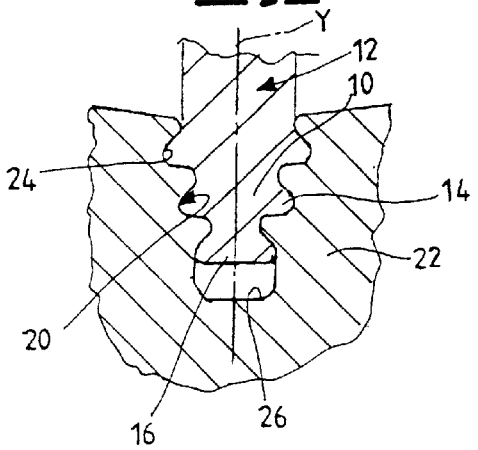
FIG. 1 is a cross-section which shows a connection between a root of a blade and a seat or end slot of a rotor disc of the "pine tree" type according to the known art.

FIG. 1 shows a connection according to the known art, between a root or foot 10 of a blade 12 and a seat or end slot 20 of a rotor disc 22 of a gas turbine.

The root or foot 10 of the blade 12 has a characteristic shape, substantially of an overturned isosceles triangle, with the two sides which converge at the base. This shape is symmetrical relative to the axis Y of the root 10.

The two sides or flanks have a grooved profile such as to form a series of teeth 14 with a rounded profile.

In the example shown in FIG. 1, three teeth 14 are provided for each side of the root 10.

A lower end 16 of the root 10 is formed by the connection of the two lower teeth 14 of the two sides of the root 10 itself.

These roots 10 are connected to the seats or coupling slots 20 complementary to them which are provided on a circumference of the rotor disc 22, such that grooves 24 on the sides of the seat 20 correspond to the teeth 14 of the root 10, and an inner end groove 26 at the base of the seat 20 corresponds to the lower end 16 of the root 10.

Figure 2:
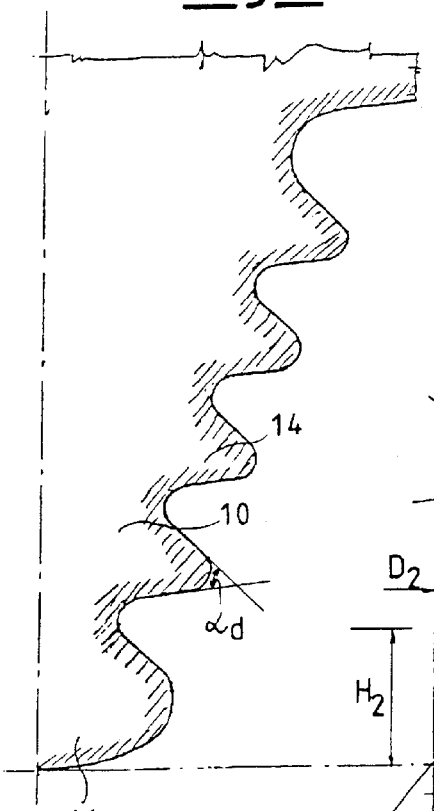
FIG. 2 is a cross-section which shows the partial profile of a root of a blade, produced according to the description of the present invention.
Figure 3:
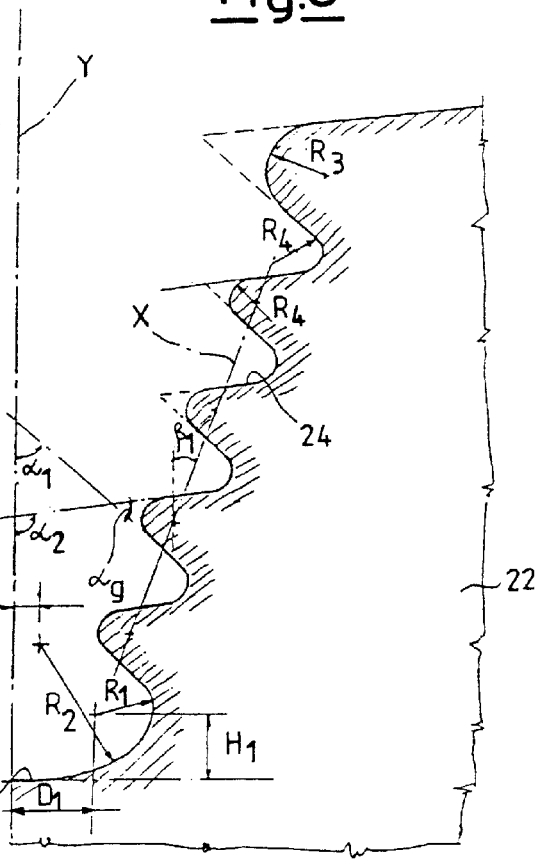
FIG. 3 is a cross-section which shows the partial profile of a seat or end slot of a rotor disc, in which the root of the blade in FIG. 2 is inserted.

FIGS. 2 and 3 show respectively partial profiles of the root 10 and of the seat 20 complementary to it, of a connection according to the present invention.

In the example shown the root 10 has four teeth 14 for each side.

A further tooth 14 which is present at a lower end of the side of the root 10 is connected by means of a connection to the similar tooth 14 which is present on the other side in order to form the lower end 16 of the root 10.

Correspondingly the seat 20 has four grooves 24 for each side.

A further groove 24 which is present at a lower end of the side of the seat 20 is connected by means of a connection to the similar groove 24 which is present on the other side in order to form the inner end groove 26 of the seat 20.

FIG. 3 shows the geometric variables which characterise the profile of the seat 20, and consequently also the root 10, which is complementary to the seat 20 itself.

The series of grooves 24 extends along a line X which is inclined relative to the axis Y of the seat 20 by an angle $\beta_1$.

Consequently the side of the seat 20 also extends according to this inclination.

The four grooves 24 have straight sides with inclinations of angles $\alpha_1$ and $\alpha_2$ relative to the axis Y of the seat 20, wherein $\alpha_1$ is the angle of the side facing the interior of the rotor disc 22.

The two sides of the groove 24 thus form a groove angle $\alpha_g$ which is equal to $\alpha_2$ subtracted from $\alpha_1$.

The groove 24 is connected at its base according to an arc of a circumference with a radius $R_4$.

In addition, between the four grooves 24 and between the lower groove 24 and the inner end groove 26, there are four connections according to an arc of a circumference with a radius $R_4$.

The side with the angle $\alpha_1$ of the upper groove 24 is connected towards the exterior of the rotor disc 22 according to an arc of a circumference with a radius $R_3$. The inner end groove 26 is in the shape of an overturned omega, with the two symmetrical upper sides disposed according to angles $\alpha_1$ relative to the axis Y of the seat 20.

These sides are connected to one another according to four arcs of four circumferences which are symmetrical relative to one another, in pairs.

More specifically, their upper side is connected initially according to an arc of a circumference with a radius $R_1$ and a centre determined by a height $H_1$ relative to the base of the inner end groove 26 and by a distance $D_1$ relative to the axis Y of the seat 20.

This arc of a circumference is followed by an arc of a circumference with a radius $R_2$ and a centre determined by a height $H_2$ relative to the base of the inner end groove 26 and by a distance $D_2$ relative to the axis Y of the seat 20.

Complementarily, as can be seen in FIG. 2, the tooth 14 of the root 10 also has straight sides with inclinations relative to the axis Y of the root 10 with the same angles $\alpha_1$ and $\alpha_2$, wherein $\alpha_1$ is the angle of the side which faces the blade 12.

The two sides of the tooth 14 thus form a toothing angle $\alpha_d$ which is equal to $\alpha_2$ subtracted from $\alpha_1$, and is thus equal to the groove angle $\alpha_g$.

The tooth 14 is connected according to an arc of a circumference with a radius $R_4$.

In addition, between the four teeth 14 and between the lower tooth 14 and the lower end 16 of the root, there exist four connections according to an arc of a circumference with a radius $R_4$.

The side with the angle $\alpha_1$ of the upper tooth 14 is connected to the blade 12 according to an arc of a circumference with a radius $R_3$.

The lower end 16 is in the shape of an overturned omega, with the two symmetrical upper sides disposed according to second angles $\alpha_1$ relative to the axis Y of the root 10.

These sides are connected to one another according to four arcs of four circumferences which are symmetrical relative to one another, in pairs.

More specifically, their upper side is connected initially according to an arc of a circumference with a radius $R_1$ and a centre determined by a height $H_1$ relative to the lower end 16 of the root 10 and by a distance $D_1$ relative to the axis Y of the root 10 itself.

This arc of a circumference is followed by an arc of a circumference with a radius $R_2$ and a centre determined by a height $H_2$ relative to the lower end 16 of the root 10 and by a distance $D_2$ relative to the axis Y of the root 10 itself.

To summarise, the eight teeth 14 of the two sides of the root 10 and the lower end 16 of the root 10 itself are inserted respectively in the eight grooves 24 in the two sides of the seat 20 and the inner end groove 26 of the seat 20 itself.

In addition, the two connections with a radius $R_3$ of the root 10 and of the seat 20 are also made to fit together simultaneously with the insertion of the root 10 in the seat 20, which is carried out by making the root 10 slide along an axial direction into the corresponding seat 20.

By means of its application with analysis of the stresses, the present invention has made it possible to reduce the concentrations of stress and to indicate a suitable geometry for the profiles of contact between the roots 10 of the blades 12 and seats 20 of the rotor disc 22.

The ratios between the radii R1, R2, R3 and R4, the heights H1 and H2, the distances D1 and D2 and the angles $\alpha_1$, $\alpha_2\beta_1$ and $\beta_1$ must be considered fundamental.

In fact these ratios determine the form of the teeth 14, as well as of the lower end 16 of the root 10, which lead to the improved connection according to the present invention.

Taking as a reference the radius $R_4$, it has been determined according to the present invention that the connection is optimised if the following ratios exist:

- the ratio between $R_3$ and $R_4$ is between 1.8 and 2.2, including extreme values;
- the ratio between $R_1$ and $R_4$ is between 1.8 and 2.2, including extreme values;
- the ratio between $R_2$ and $R_4$ is between 5.5 and 6, including extreme values.

Simultaneously, the following ratios must exist for the angles:

the angle $\alpha_1$ is between 42° and 48°, including extreme values;

the angle $\alpha_1$ is between 94° and 100°, including extreme values;

the angle $\beta_1$ is between 17° and 23°, including extreme values.

With these ratios, the groove angle $\alpha_g$, which is equal to the toothing angle $\alpha_d$ is between 46° and 58°, including extreme values.

The heights $H_1$ and $H_2$ and the distances $D_1$ and $D_2$ are determined as a direct consequence of the general dimensions of the root 10, i.e. substantially after having determined the height of the root 10.

According to the present invention it is thus found that the best results are obtained by using roots 10 with four teeth 14, according to the embodiment shown in FIGS. 2 and 3, or roots 10 with five teeth 14.

The description provided makes apparent the characteristics of the improved connection according to the present invention for blades on a rotor disc of a gas turbine, as well as its advantages, which it should be noted include:

increase in the service life of the components;

increase in the speed of rotation of the machines, or increase in the temperature of the fluid, or an appropriate combination of the two aspects; and costs which are low compared with the known art, since the profiles can always be obtained by broaching, as is already the case for the connections according to the known art.

Finally it is apparent that many modifications and variations, all of which come within the scope of the invention, can be made to the improved connection thus designed for blades on a rotor disc of a gas turbine; in addition all the details can be replaced by elements which are technically equivalent.

In practice any materials, forms and dimensions can be used, according to the technical requirements.

The scope of protection of the invention is thus delimited by the attached claims.

What is claimed is:

1. A connection between a turbine blade and a rotor disc of a gas turbine comprising:

a blade root and a seat on the rotor disc generally complementary in shape to one another, said root having a general shape of an overturned isosceles triangle with two sides convergent toward a base of said root and having a grooved profile forming a plurality of teeth, a lower end of said root being formed by a joined connection of two lower teeth of the two sides of the root, said lower teeth being required in grooves formed in the sides of the seat, said lower end of said root corresponding to an inner end of the groove in the seat, said plurality of grooves extending along a line inclined relative to a diametrical axis of said seat by an angle $\beta_1$ of between 17° and 23° inclusive, said grooves having straight sides with inclinations relative to said diametrical axis of angles $\alpha_1$ and $\alpha_2$ wherein $\alpha_1$ is the angle of the side facing the interior of the rotor disc and is between 42° and 48° inclusive, the angle $\alpha_2$ being between 94° and 100° inclusive;

said grooves on said seat sides being connected on the base according to an arc of a circumference with a radius $R_4$, said teeth being provided between said grooves according to an arc of a circumference having said radius $R_4$, a side of an outer groove of said seat groove with the angle $\alpha_1$ being connected towards the exterior surface of the rotor disc according to an arc of a circumference with a radius $R_3$, an inner end groove of said seat being in the general shape of an overturned omega with two symmetrical upper sides thereof disposed according to angles $\alpha$, relative to the diametrical axis of the seat and are connected to one another by two arcs each on opposite sides of the seat, one of said arcs having a radius $R_1$ and a second of said arcs having a radius $R_2$, wherein the radii $R_1$, $R_2$ and $R_3$ have the following ratios to the radius $R_4$:

$$1.8 \leqq R_3/R_4 \leqq 2.2;$$

$$1.8 \leqq R_1/R_4 \leqq 2.2; \text{ and}$$

$$5.5 \leqq R_2/R_4 \leqq 6.$$

2. A connection according to claim 1 in that a groove angle equal to the angle $\alpha_2$ subtracted from the angle $\alpha_1$, is between 46° and 58°, including extreme values.

3. A connection according to claim 1 wherein said seat has eight grooves which are symmetrical in pairs, and an inner end groove.

4. A connection between a turbine blade and a rotor disc of a gas turbine comprising:

a blade root and a seat on the rotor disc generally complementary in shape to one another said root having a general shape of an overturned isosceles triangle with two sides convergent toward an inner end of said root with each side having a grooved profile forming a plurality of teeth, a lower end of said root being formed by a joined connection of two lower teeth of the two sides of the root, said lower teeth corresponding to grooves formed in the sides of the seat, said lower end of said root corresponding to an inner end groove formed in the base of the seat, said plurality of grooves extending along a line incline relative to a diametrical axis of said seat by an angle $\beta_1$ of between 17° and 23° inclusive, said grooves having straight sides with inclinations relative to said axis of angles $\alpha_1$ and $\alpha_2$ wherein $\alpha_1$ is the angle of the side facing the interior of the rotor disc and is between 42° and 48° inclusive, the angle $\alpha_2$ being between 94° and 100° inclusive, said connection between said lower teeth being in accordance with an arc having a radius $R_1$ produced with a center point determined by a height $H_1$ relative to a base of the inner end groove and by a distance $D_1$ relative to the diametrical axis of the seat, and an arc having a radius $R_2$ from a center point determined by a height $H_2$ relative to a base of the inner end groove and by a distance $D_2$ relative to the diametrical axis of the seat.

* * * * *